US005218803A

United States Patent [19]

Wright

[11] Patent Number: 5,218,803

[45] Date of Patent: Jun. 15, 1993

[54] METHOD AND MEANS FOR REINFORCING A STEEL STUD WALL

[76] Inventor: Jeff A. Wright, 4904 Refugio, Carlsbad, Calif. 92008

[21] Appl. No.: 787,084

[22] Filed: Nov. 4, 1991

[51] Int. Cl.[5] ..... E04B 2/62

[52] U.S. Cl. ..... 52/243; 52/664; 52/488

[58] Field of Search ..... 52/349, 238.1, 241, 52/242, 243.1, 483, 664, 243; 403/382

[56] References Cited

U.S. PATENT DOCUMENTS 1,475,409 11/1923 Riddle ..... 52/349

3,245,185 4/1966 Rowe ..... 52/238.1

3,831,333 8/1974 Nelsson et al. ..... 403/230

*Primary Examiner*—James L. Ridgill, Jr.

*Attorney, Agent, or Firm*—Ralph S. Branscomb

[57] ABSTRACT

An L-shaped brace is used for reinforcing free-standing, light gauge, steel studs, gypsum board walls which are built up from a standard size, light-gauge track which is mounted to the floor. The brace has one leg which is fastened to the floor through the track, with the other leg extending vertically and being fastened either to one of a steel stud, or to the inside of a vertically extended length of track used to define the end of a free-standing wall.

5 Claims, 2 Drawing Sheets

Fig. 1
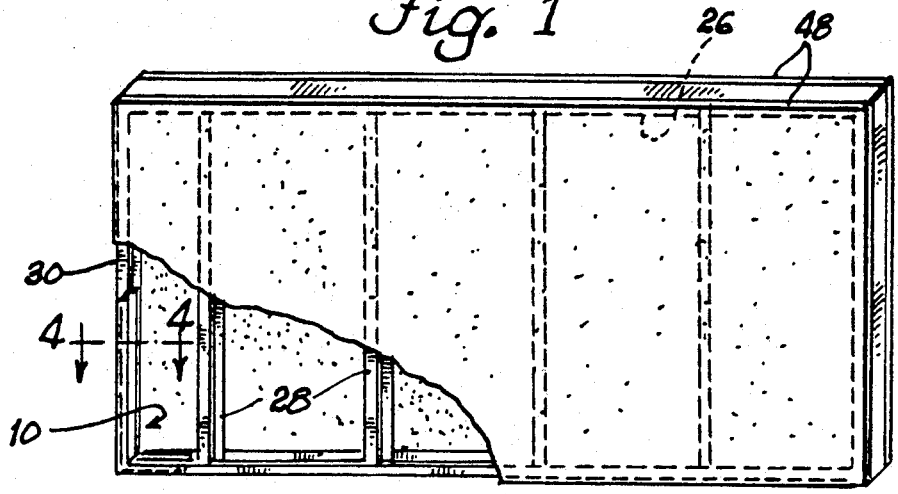
Fig. 2
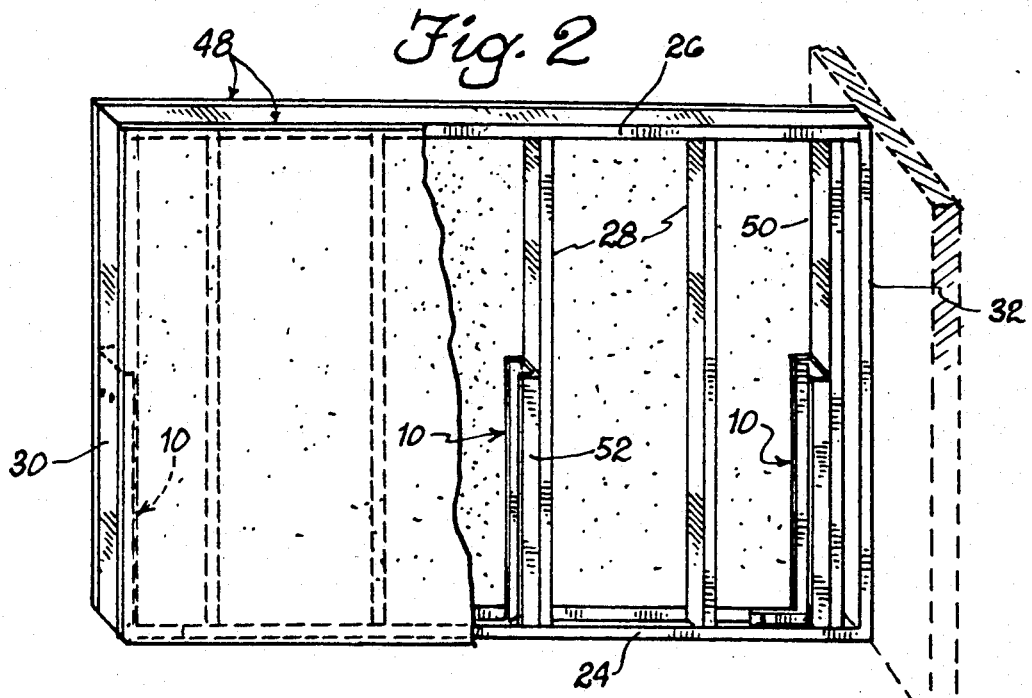
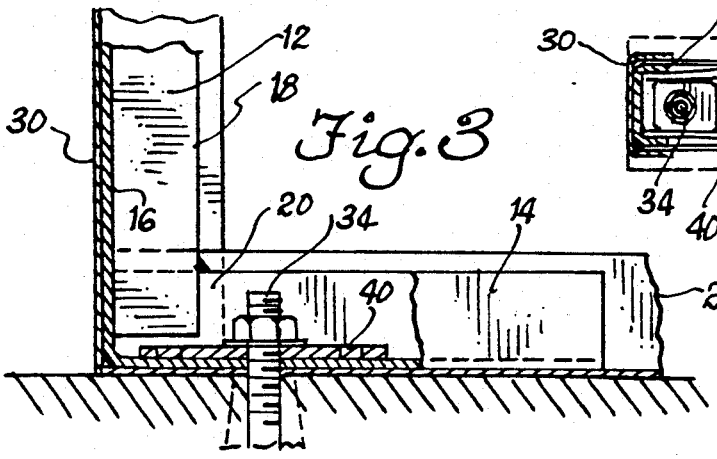
Fig. 3
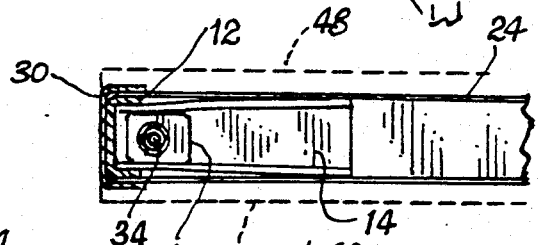
Fig. 4

30
44
16
18
12
10
40
42
14
20
22
38
36
34
24
46

METHOD AND MEANS FOR REINFORCING A STEEL STUD WALL

BACKGROUND OF THE INVENTION

A traditional wall for residential or light commercial-/industrial buildings in the United States is made from soft wood 2"×4" studs which are vertically oriented and horizontally spaced on 16 inch centers, being capped at the top and the bottom with a 2"×4" header and footer, respectively. This frame is then sandwiched between gypsum board panels, sometimes referred to as "drywall".

Walls made of wooden 2"×4" construction which do not go all the way to the ceiling, and define pony walls, stud walls or cubicle walls are naturally not as strong as the wall would be if it went all the way to the ceiling and was anchored to the ceiling joist structure. However, 2"×4" wooden stud construction is strong enough that free standing walls which don't reach the ceiling, or short walls terminating midway across a room, would nevertheless be strong enough with the drywall sheathing to stand up to normal use without additional support.

Relatively recently a sheet metal channel stud has been introduced to the building industry as a replacement for the wooden 2×4 stud. Wall construction utilizing steel studs ordinarily incorporates steel tracks at the bottom and top of the wall. The steel tracks are similar in shape to the studs but are slightly wider to seat the stud top and bottom end within the tracks. The studs are fastened to the track with sheet metal screws, and drywall is subsequently applied in a manner similar to that in which it is applied to wooden stud walls when drywall screws are used instead of nails. If there is a free-standing end of a wall, it is capped with a length of track, rather than a stud, as the track is somewhat stronger, is the right finished dimension, and has no pass-through holes for electrical conduits and pipes.

The advantage of steel stud and track construction is that it is substantially cheaper than wooden stud construction. A drawback, however, is that steel stud construction is not as rigid or strong as wooden construction. Steel stud walls tend to be somewhat flimsy, despite the contrary positions taken by its proponents. Whereas a normal steel-stud wall is adequately strong to stand up in daily use, a short wall which does not reach the ceiling, particularly one which terminates in the middle of a room leaving an unsupported end wall, is scarcely adequate to sustain the ordinary abuse that it will take, without overhead support. A pony wall, having both ends free-standing and not reaching the ceiling, is very inadequate from a rigidity and strength perspective when made with sheet metal steel studs.

There is a need for a means to reinforce these short, pony, stub, or cubicle walls when they are made with track and steel stud construction so that they are equally strong, or even stronger, than similar walls made according to the techniques of conventional wooden stud construction.

SUMMARY OF THE INVENTION

The instant invention fulfills the above stated need by providing a special brace particularly adapted to fit within steel stud walls to reinforce one or more of the steel studs, or a vertical end track section, so that the wall can withstand average use despite the fact that it is not supported overhead, or that it terminates in a room.

The L-shaped brace used as the support is itself made from steel channel construction but it is of much heavier duty than the gauge of either the standard steel studs or the length of track that are otherwise used in the wall. One leg of the brace is seated inside the floor track of the wall and fastened through the track to the underlying floor or subfloor, either with a foundation bolt, or wood screws, or explosive charged concrete nails or pins. A reinforcing plate is preferably used over the horizontal leg of the brace to reinforce the hole areas through which the concrete nails, screws, or the anchor bolt is passed.

BRIEF DESCRIPTION OF THE DRAWINGS

FIG. 1 illustrates a complete pony wall with one corner of one wall board face cut away to illustrate the internal construction;

FIG. 2 is a perspective view from the right and upper side of a wall similar to the wall of FIG. 1, but having a stud-capped end wall, with the right portion of the front wallboard cut away to illustrate the internal construction;

FIG. 3 is a longitudinal section taken through the brace as it appears in use;

FIG. 4 is a section taken along line 4—4 of FIG. 1;

DETAILED DESCRIPTION OF THE PREFERRED EMBODIMENT

Figures 5, 6:
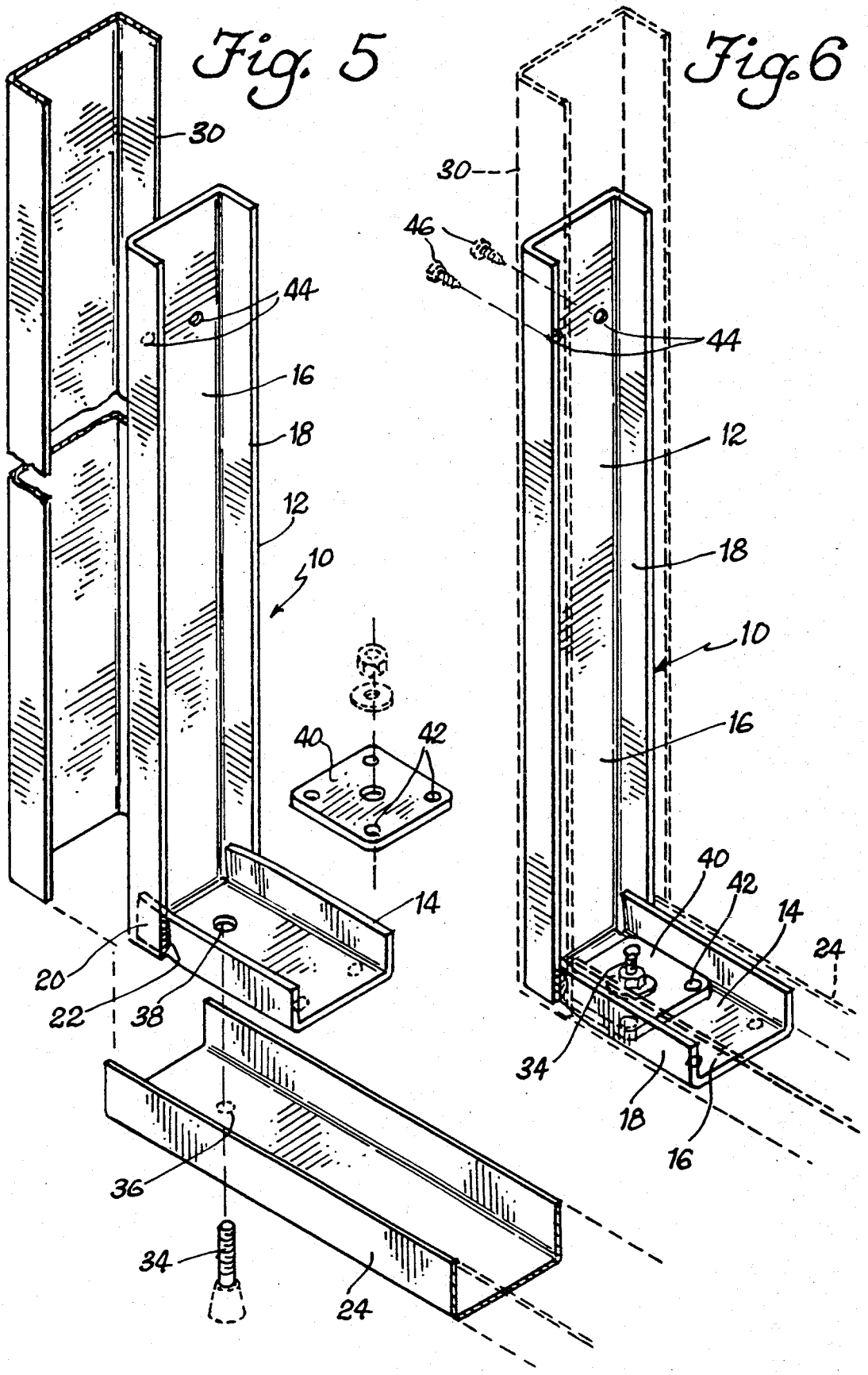
FIG. 5 is a exploded perspective view illustrating the mounting of the brace in a floor track and an end wall track; and, FIG. 6 illustrates the structure of FIG. 5 after it is assembled, with the vertical track being shown in phantom and the vertical track fastening screws being exploded.

The brace is shown at 10, having a vertical leg 12 and a horizontal leg 14. In the preferred embodiment, the vertical leg is on the order of 24" length while the horizontal leg is on the order of 6" long. Both legs are preferably constructed of heavy duty, 14 gauge steel. The legs are channel members having end panels 16 from which side panels 18 orthogonally extend. The two legs are joined at the perpendicular joint 20, where the ends of the side panels of the horizontal leg are crimped inwardly to fit within the joint ends of the side walls of the vertical leg 12, and welded together as indicated at 22. This produces an extremely strong brace, probably hundreds of times stronger than the joint between a typical steel stud and a track, or between a steel stud and a track.

According to conventional steel stud construction, a length of floor track 24 is first mounted to the floor or subfloor to define the exact position of the wall. Assuming the wall does not reach the ceiling, there would not be a similar track mount in the ceiling. The next step would ordinarily be to fasten the steel studs to the floor track with self-tapping metal screws, capping them in mid-air with a track that is similarly sized to the floor track. Such a track is shown at 26 in FIGS. 1 and 2. The steel stud 28 are connected to the upper and lower tracks by self-tapping metal screws which pass through the respective members.

If the wall is free standing, or at least if one end is free standing, it may terminate either in a vertical length of track 30, or an end stud 32. In any event, the brace must first be fastened down to the floor or subfloor, which may be done in the most appropriate of several different ways. As shown in FIGS. 5 and 6, and also 3, if there is an anchor bolt 34 extending up from the concrete foundation or slab, it will pass up through the hole 36 in the floor track, and subsequently up through the appropriately positioned anchor bolt hole 38 of the brace, which will be seated down onto the upstanding threaded end of the bolt. To further strengthen the unit, a reinforcing plate 40 is preferably, but not necessarily, dropped over the anchor bolt which is then fixed with a nut, which is tightened down to anchor the brace. The plate 40 is 3/16" thick and is also preferably provided with peripheral holes 42. These holes can be used to fasten the unit to a wooden floor or subfloor with wood screws, or to underlying concrete with concrete nails. Supplemental holes 44 may also be provided in the brace leg itself for similar purposes. When an anchor bolt is not used, the vertical leg would be compressed tightly against the rib to which it will be attached before the horizontal leg is anchored.

The vertical track 30 may be installed before or after the brace is mounted, and in any event is fastened with sheet metal screws 46, or self-tapping, sheet metal screws, which engage in the appropriately positioned holes in the vertical leg of the brace.

Once the brace has been securely installed, the drywall, or gypsum board, 48 can be installed on both sides of the walls as shown in FIGS. 1 and 2.

According to the construction just described, the vertical leg of the brace nests inside the vertical track member 30, and is fastened to its end panel. In all instances, the two legs of the brace are concave inwardly, and the end rib, whether it be a track section 30 or an end stud 32, is concave inwardly of the wall. All of these members are U-shaped, having a flat planar back member and two flanges or side walls. Because the tracks are made slightly wider than the studs and the legs of the brace, the brace can seat inside the track.

However, FIG. 2 illustrates a slightly different construction in which the above-referenced end stud 32 is used to terminate the wall rather than an end track section. This stud is inwardly concave, as indicated above. Because it is of the same basic external dimension as the vertical leg of the brace, the brace cannot nest or seat inside the stud as it can in the track. Therefore, when supporting a stud rather than a vertical track section, the vertical leg of the brace and the stud must be fastened back-to-back as shown in FIG. 2. To position the wall support as close to the unsupported end wall as possible, a special stud 50 is inserted and fastened to the wall as shown in FIG. 2. The brace is then mounted back-to-back to this stud. End wall support is thus spaced only two or three inches from the actual end of the wall.

Also shown in FIG. 2 is a central brace 52 which does not support an end wall at all, but is central of the pony wall illustrated in FIG. 2. Thus, braces can be put intermediate the ends, as well as at each free-standing end of any wall. For example, a low wall passing substantially across an entire room could be reinforced by the use of periodic bracing throughout its length.

That summarizes the three basic uses of the brace. That is, the brace can be used to support an end wall terminating in a vertical track section, an end wall terminating in a stud in which case a special stud must be added, or the brace may be used intermediate the ends of a wall which may not even need end support if it has no free-standing ends. Actually, the brace can be used to reinforce any vertical rib, whether it be a steel stud, a wood stud, a vertical track section, or any other type of supporting rib. It provides an inexpensive, easy-to-install means of quickly upgrading a free-standing wall from a flimsy creation that will not withstand a substantial impact, to one that is stronger than a similar, unreinforced wall fabricated of wood studding.

It is hereby claimed:

1. A wall construction for producing a reinforced partial wall which terminates short of the ceiling and is of adequate strength despite the use of steel-stud construction, comprising:

(a) a length of floor track mounted to an underlying surface;

(b) a plurality of vertically extended, horizontally spaced steel-stud ribs defining a wall plane which extends up from the floor stopping short of the ceiling and has at least one unsupported end;

(c) the lower ends of said ribs nesting in said track and being fastened thereto with at least one of said ribs being disposed near said unsupported end of said wall;

(d) two gypsum sides sandwiching said ribs therebetween; and, (e) at least one L-shaped brace with legs of substantially greater thickness and strength than that of said ribs, and having one leg lying inside said track and being fastened directly and very securely to the underlying surface through said track with conventional fastener means designed to adequately withstand reasonable lateral forces expected from normal residential or commercial use, with the other leg extending upright and being fastened to said at least one of said ribs to reinforce same at the end of said wall, with said other leg extending up a substantial portion of the height of said wall to reinforce same well beyond the bottom region immediately adjacent said floor track.

2. Structure according to claim 1 wherein said at least one of said vertical ribs disposed near one end of said wall terminates one end of said wall and is an inwardly concave track section, and said upright leg nests inside said track section.

3. Structure according to claim 1 wherein said wall terminates at one end in an inwardly directed concave steel end stud, and including a special stud in said wall being concave towards said end stud, the upright leg of said L-shaped beam butting back-to-back against said special stud.

4. Structure according to claim 1 wherein said legs comprise U-shaped channel members with the concave faces facing inwardly, and said one leg is fastened to the underlying surface by means of an apertured plate which fits inside said horizontal U-shaped leg and a heavy duty construction fastener which passes down through the aperture into the underlying surface.

5. Structure according to claim 4 wherein said channel members are each made of 14 gauge steel, said upright legs is on the order of 24 inches tall and said horizontal leg is on the order of 6 inches tall such that a substantial portion of the height of said wall is directly reinforced by said brace.

* * * * *